US006425411B1

(12) United States Patent
Gorges

(10) Patent No.: US 6,425,411 B1
(45) Date of Patent: Jul. 30, 2002

(54) OIL SEALANT-PRESERVING DRAIN ODOR TRAP

(76) Inventor: Ditmar L. Gorges, 11660 Mayfield Ave., No. 401, Brentwood, CA (US) 90049

( * ) Notice: Subject to any disclaimer, the term of this patent is extended or adjusted under 35 U.S.C. 154(b) by 0 days.

(21) Appl. No.: 09/855,735

(22) Filed: May 14, 2001

Related U.S. Application Data

(63) Continuation-in-part of application No. 09/515,870, filed on Feb. 29, 2000, now abandoned, which is a continuation of application No. 09/051,976, filed on Sep. 14, 1998, now Pat. No. 6,053,197, and a continuation of application No. PCT/US95/16064, filed on Dec. 11, 1995, and a continuation of application No. PCT/US95/17187, filed on Oct. 25, 1995, which is a continuation-in-part of application No. 08/548,281, filed on Oct. 25, 1995, now abandoned.

(51) Int. Cl.[7] ..... E03C 1/29; E03C 1/28

(52) U.S. Cl. ..... 137/247.39; 137/362; 4/144.1; 4/679

(58) Field of Search ..... 137/246, 247.11, 137/247.33, 247.35, 247.39, 362; 4/144.1, 310, 311, 679

(56) References Cited

U.S. PATENT DOCUMENTS

| | | | | | |
|---|---|---|---|---|---|
| 303,430 | A | * | 6/1884 | Griffin | 137/247.33 |
| 303,822 | A | * | 8/1884 | D'Heureuse | 4/679 |
| 668,776 | A | * | 2/1901 | Riley | 137/247.11 |
| 748,936 | A | * | 1/1904 | Edelen | 137/247.33 |
| 818,164 | A | * | 4/1906 | Hannagan | 137/247.33 |
| 1,050,290 | A | * | 1/1913 | Posson | 4/223 |
| 1,596,997 | A | * | 8/1926 | Rawlings | 137/247.33 |

(List continued on next page.)

FOREIGN PATENT DOCUMENTS

| | | | |
|---|---|---|---|
| CH | 241369 | * | 7/1946 |
| DE | 72361 | * | 1/1894 |
| DE | 121356 | * | 6/1901 |
| DE | 318264 | * | 6/1918 |
| DE | 2816597 | * | 5/1980 |
| FR | 663749 | * | 8/1929 |
| FR | 1413819 | * | 8/1965 |

(List continued on next page.)

*Primary Examiner*—John Rivell
(74) *Attorney, Agent, or Firm*—Lewis B. Sternfels

(57) ABSTRACT

Improvements in retention of the oily liquid sealant (20) in a oil-sealed odor trap (10B–10M), for drain applications such as a waterless urinal or anti-evaporation floor drain, are accomplished by minimizing turbulence in the oil sealant, such as by making the liquid flow path (22A, 22B) substantially horizontal as a departure from conventional practice of substantially vertical flow and by positioning a barrier (40) above the oil sealant to prevent direct impingement of urine or other waste products onto the sealant. The trap is thus structured to realize the substantially horizontal liquid flow path and to locate the flow path immediately beneath the sealant layer or beneath a baffle portion (16B). The baffle portion may be sloped such that stray sealant droplets are encouraged to migrate upwardly to the upper surface of the flow path due to their buoyancy and, therefore, the stray droplets will be recaptured and returned to the main sealant layer. To accomplish substantially horizontal flow, the entry compartment can be made to have entry and exit openings (16D, 14E) substantially offset from each other. The baffle between the entry compartment and the discharge compartment, which has traditionally been made entirely vertical, is made to have a non-vertical portion that is preferably sloped for sealant recovery. A sealant sheltering region (T) with an air vent (16F) can be provided in the vicinity of the entry region to prevent catastrophic loss of sealant in the event of high pressure water flushing. When the trap is embodied as a replaceable cartridge, a tool with hook-shaped projections, such as L-shaped or T-shaped projections (183, 183A), engageable with openings (154) in an upper wall (152) of the cartridge is used to help removal and replacement of the cartridge.

30 Claims, 6 Drawing Sheets

U.S. PATENT DOCUMENTS 2,603,304 A * 7/1952 Carrier ..... 137/247.11
3,829,909 A * 8/1974 Rod et al. ..... 4/318
4,026,317 A * 5/1977 Ekstrom ..... 137/216.1
4,028,747 A * 6/1977 Newton ..... 4/317
4,043,354 A * 8/1977 Brown ..... 137/247.33
4,045,346 A * 8/1977 Swaskey ..... 137/247.33
4,244,061 A * 1/1981 Webster et al. ..... 4/144.1
4,263,934 A * 4/1981 Redden et al. ..... 137/247.39
4,275,760 A * 6/1981 Kessel ..... 137/247.35
4,411,286 A * 10/1983 Ball ..... 137/253
4,432,384 A * 2/1984 Guiboro ..... 137/247.39
4,773,441 A * 9/1988 Biba ..... 137/247.33
4,922,948 A * 5/1990 Van Dijk ..... 137/247.33
5,159,724 A * 11/1992 Vosper ..... 137/247.35
5,203,369 A * 4/1993 Hwang ..... 137/247.39
5,711,037 A * 1/1998 Reichardt et al. ..... 4/144.1

FOREIGN PATENT DOCUMENTS

GB 01002 * of 1868
GB 2078813 * 1/1982
WO 94/25693 * 11/1994

* cited by examiner

FIG. 14
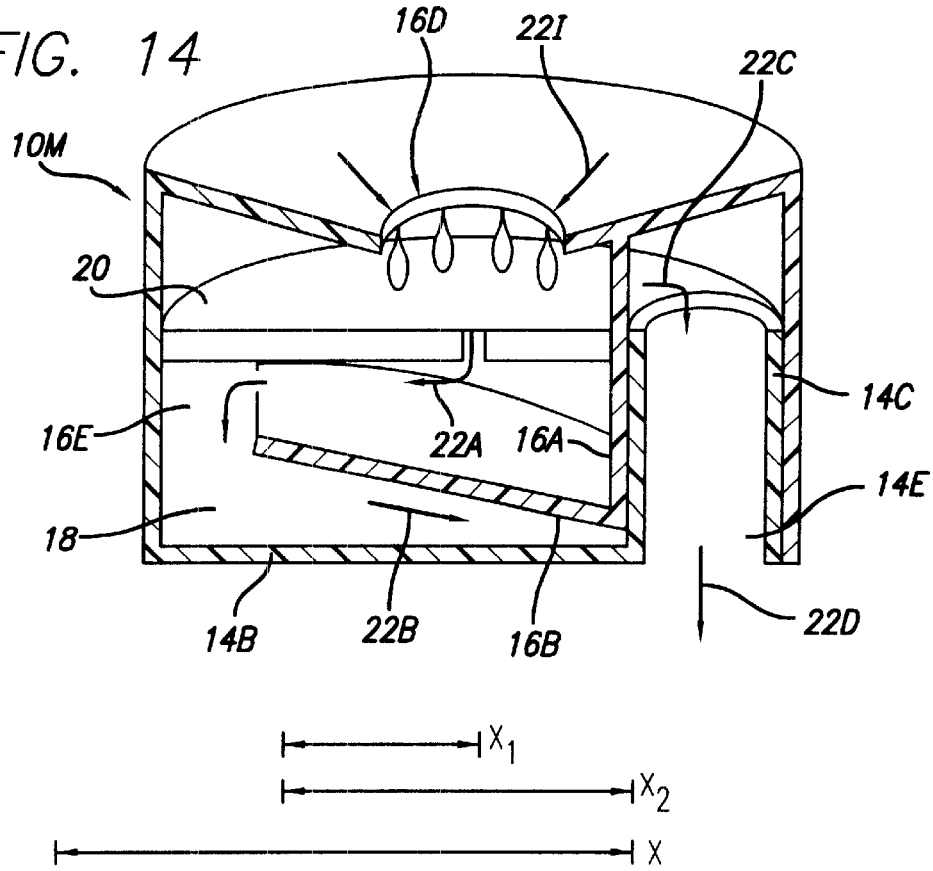
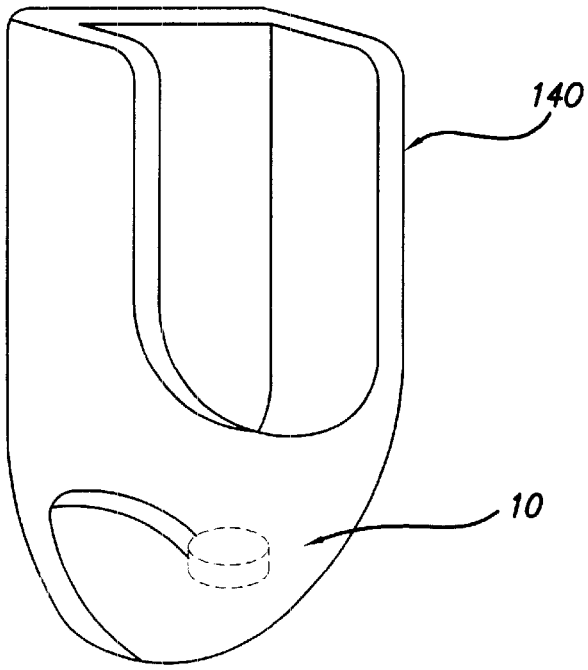
FIG. 15

OIL SEALANT-PRESERVING DRAIN ODOR TRAP

CROSS-REFERENCE TO RELATED APPLICATION

The present application is a Continuation-in-Part of U.S. patent application Ser. No. 09/515,870 filed Feb. 29, 2000, now abandoned, which is a Continuation of U.S. patent application Ser. No. 09/051,976, filed Sep. 14, 1998 now U.S. Pat. No. 6,053,197, and PCT Application Ser. No. PCT/US95/17187, filed Oct. 25, 1995, which is a Continuation-In-Part of both U.S. patent application Ser. No. 08/548,281, filed Oct. 25, 1995, now abandoned, and PCT Application No. PCT/US95/16064, filed Dec. 11, 1995, both entitled Horizontal-Flow Oil-Sealant-Preserving Drain Odor Trap.

REFERENCE REGARDING FEDERAL SPONSORSHIP

Not Applicable

REFERENCE TO MICROFICHE APPENDIX

Not Applicable

BACKGROUND OF THE INVENTION

1. Field of the Invention

The present invention relates to sealed odor traps for waterless urinals, anti-evaporation floor drain traps and, more particularly, to improvements in the internal structure of oil-sealed odor traps for prolonging sealant retention and for protection against high pressure water flushing.

2. Description of Related Art and Other Considerations

With increasing emphasis on water conservation, there is continuing interest in toilets and urinals designed to minimize the amount of water consumed in flushing, to mitigate excessive demands on both water supplies and wastewater disposal systems, both of which have tended to become overloaded with increasing populations.

Sanitation codes require urinals to provide an odor seal to contain gasses and odors which develop in the drain system; this function is conventionally performed by the well known P-trap or S-trap in which the seal is formed by a residual portion of the flushing water. This seal effectively provides a barrier to sewer odors from passing from the drainpipe beyond the trap. However, the upward-facing liquid surface communicates freely with the user environment and, therefore, the trap must be kept free of residual urine by copious flushing to prevent unacceptable odor levels from the liquid in the trap. As a result, a large amount of water is consumed in flushing these conventional urinals. Especially in the United States over many years when water was cheap and plentiful, conventional flushing type urinals and water-wasteful toilets held an unchallenged monopoly. However, more recently, threatened and real water shortages have aroused new environmental concerns and heightened conservation awareness as evidenced by the introduction of low flush toilets.

As the cost of water increases and budgets tighten, the prospect of a viable waterless urinal system becomes extremely attractive to a wide range of public agencies, cities, states, penal institutions, defense establishments, recreational and parks departments and the like. Waterless urinals utilizing oil-sealed odor traps are becoming viable. However, the present inventor has discovered that a key factor in their potential is the attainment of low maintenance, and that this is largely dependent on the longevity of the liquid sealant which, in turn, is related to the internal structure of the odor trap. Thus, the present inventor has recognized that improvements are desirable both in the rate of depletion under normal service conditions and in protection against catastrophic sealant loss due to high pressure water flushing which, though not required, can occur inadvertently.

Known prior art is listed, as follows.

List of References

| U.S. Pat. No. : | Patentee: | Patent No: | Patentee: |
|---|---|---|---|
| 303,822 | D'Heureuse | 4,411,286 | Ball |
| 1,050,290 | Posson | 4,432,384 | Guiboro |
| 3,829,909 | Rod, et al. | 4,773,441 | Biba |
| 4,026,317 | Ekstrom | 5,159,724 | Vosper |
| 4,028,747 | Newton | 5,203,369 | Hwang |
| 4,045,346 | Swaskey | 318264 Germany | Zeigler |
| 4,244,061 | Webster, et al. | 2816597.1 Germany | Ernst |
| 4,263,934 | Redden, et al. | 606,646 Switzerland | Ernst |

Statement of the Prior Art

U.S. Pat. No. 303,822 (D'Heureuse) discloses a wastewater pipe S-trap into which a disinfectant or deodorizer is introduced.

The use of an oil as a recirculated flushing medium in a toilet system is disclosed in U.S. Pat. No. 3,829,909 (Rod, et al.).

The use of oil in toilets to form an odor trap is disclosed in German Patent No. 121356 (Beck, et al.) and in U.S. Pat. Nos. 1,050,290 (Posson) and U.S. Pat. No. 4,028,747 (Newton).

Bell traps, essentially a coaxial form of S-trap, have been known for over a century; a popular form is exemplified in German Patent No. 318264 (Zeigler). A multiple baffle structure is disclosed in U.S. Patent No. 4,026,317 (Ekstrom). Center-entry coaxial trap configurations are shown in U.S. Pat. No. 4,045,346 (Swaskey) and U.S. Pat. No. 5,203,369 (Hwang).

Beetz introduced an oily liquid layer floating in the trap as an odor barrier through which urine and water can permeate downward. Beetz makes the oil mixture have disinfectant properties and to have "innate adhesion power to attach itself to the odor lock parts so that the latter cannot be attacked by urine". The Beetz disclosure includes daily maintenance, including cleaning, and coating the cast iron parts of the urinal, including the housing of the odor trap, with the oil mixture that "the oil has the property that said parts absorb so much of it that the oil film somehow repels the urine". Beetz requirement for daily cleaning and maintenance dictates an easily-disassembled-three piece structure with a leakage-prone bottom interface joint, and this requirement for the sealant to also act as a disinfectant is now believed to have caused excessive depletion of the sealant.

Other examples of oil-sealed traps are found in German Patent No. 2816597.1, and Swiss Patent No. 606,646 (Ernst), practiced under the trademark SYSTEM-ERNST.

The foregoing examples of traps found limited use in Europe. Typically, they are utilized in a "low flush" rather than a "waterless" manner, e.g. the Beetz patent was classified under water pipe lines, and the specification thereof refers to "water and urine". The odor trap is mounted beneath the floor level and set in a concrete swale, functioning as an occasionally-flushed trough type or stall urinal of a type which is no longer recognized in United States building and sanitation codes.

A flushless urinal disclosed in U.S. Pat. No. 4,244,061 (Webster, et al.) uses no oil, but instead relies on a small "plug flow" entrance opening associated with a P-trap, and is based on the premise that "the urine in the trap during normal use will be fresh and therefore without unpleasant odor."

A unitized cylindrical cartridge odor seal for a waterless urinal is disclosed by the present inventor as a joint inventor in U.S. patent application, Ser. No. 08/052,668 filed Apr. 27, 1993 and in a continuation-in-part thereof Ser. No. 08/512,453 filed Aug. 8, 1995, in the category of an oil-sealed coaxial edge-entry trap having a cap part with an attached downward-extending tubular vertical partition.

A key parameter of oil-sealed odor traps for waterless urinals is the amount of sealant depletion that takes place under normal service conditions over periods of time and frequency of usage. Related to this is the possible partial or complete loss of sealant due to the abnormal condition of unnecessary but unavoidable high pressure flushing with water. While some modern oil-sealed odor traps are considerably improved over early versions, there remains an unfulfilled need for further improvements in the above-described aspects of sealant preservation; such improvements are provided by the present invention.

SUMMARY OF THE INVENTION

These and other problems are successfully addressed and overcome by the present invention, which comprises a unitized oil-sealed odor trap that departs from conventional practice of predominantly vertical liquid flow through the trap. Instead, the trap is constructed and arranged in a special manner to provide minimum turbulence on the oil sealant.

Preferably, minimization of turbulence is effected by a design in which a substantial portion of the total flow path is directed in a generally horizontal path and stray droplets of sealant, due to buoyancy, are encouraged to migrate upwardly back to the main body of the sealant, either directly or as guided by a sloping baffle configuration. Turbulence may be further discouraged by preventing direct contact of waste liquid from impinging directly on the sealant. In addition, an air vent in a shelter region above the sealant acts as a safety outlet against unusually high pressures exerted upon the sealant. Thus, escaping of sealant down the drain is largely prevented.

The odor trap is configured such that it can be economically made, for example, from two molded plastic parts, i.e., a main compartment part and a cap/baffle part, that can be molded from plastic and joined by thermal bonding into a unit configured as a replaceable cylindrical cartridge that can be charged with sealant and sealed with a sticker for shipment so that, upon installation, it is necessary only to install the cartridge and remove the sticker.

In service, required maintenance, i.e., sealant checking and replenishment, if and when needed, can be easily performed with the unit in place.

The cartridge is shaped to be easily pushed into place by hand and held frictionally in a mating recess provided by a casing that can be installed as part of the host plumbing, either in a urinal or in a floor drain. For drain cleaning or replacement purposes, the odor trap can be removed with a special simple hand tool.

However, should it be desired, the odor trap may be integrated into a urinal or similar device.

The shape of the entry compartment provides a sheltered region to which sealant tends to be temporarily displaced in the event of high pressure water flushing, thus avoiding catastrophic sealant loss.

Several advantages are derived from this arrangement. The usual objectives of eliminating the need for a P-trap in the drain line are met, while complying with United States sanitation standards. Turbulence in the sealant layer is at least minimized, if not essentially eliminated. Manufacturing and installation is economical and easy. Performance is reliable and efficient, with low maintenance requirements. Particularly with regard to depletion of oily liquid sealant, any stray droplets of sealant drift buoyantly in the flow path and return to the main sealant body. The odor trap configuration is such as to enable easy installation and removal from a permanent drain terminal plumbing fixture. Loss of sealant in the event of high pressure flushing with water is minimized, if not prevented Other aims and advantages, as well as a more complete understanding of the present invention, will appear from the following explanation of exemplary embodiments and the accompanying drawings thereof.

BRIEF DESCRIPTION OF THE DRAWINGS

FIG. 14 shows a cross-sectional view of another preferred embodiment of the present invention;

FIG. 15 shows an example of a wall mounted urinal in which an odor trap can be incorporated;

FIG. 16 is a bottom view of a top member thereof; FIG. 17 is a perspective side view of a middle member thereof; FIG. 18 is a perspective side view of a bottom member thereof (with upper and middle members represented in part in dotted lines); and FIG. 19 is a perspective side view of a plug-handle member capable of being included in this embodiment.

DETAILED DESCRIPTION OF THE PREFERRED EMBODIMENTS

Figure 1:
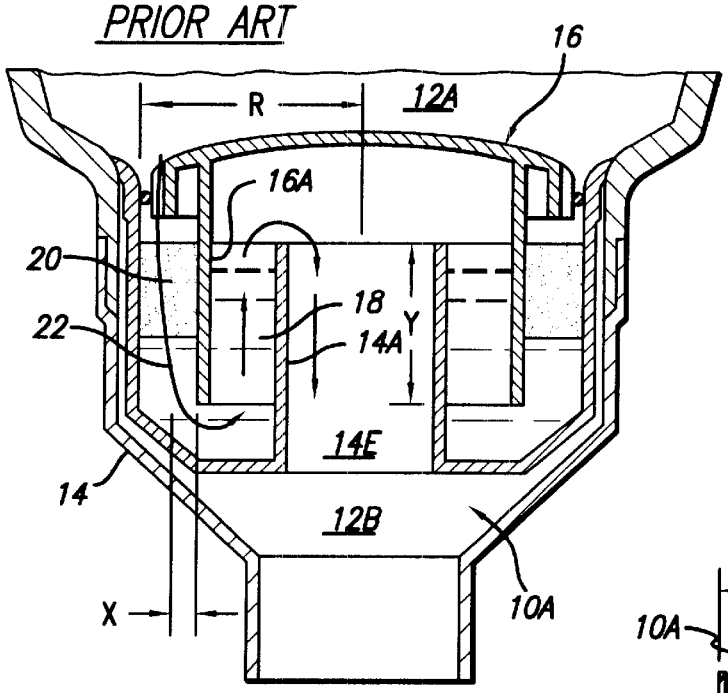
FIG. 1 PRIOR ART
FIG. 1 is a cross-sectional view of an oil-sealed coaxial odor trap of known art.

FIG. 1 is a mid cross-sectional view of an odor trap 10A of the edge-entry trap configuration of known art as described above, and configured as a cylindrical cartridge.

Odor trap 10A has a main liquid container 14 extending from an outer wall to an inner wall that forms a drain stand pipe 14A which defines, at its upper edge, the overflow level of liquid in the container 14. An overhead cap portion 16 is formed to provide a vertical baffle 16A which extends down into container 14 and divides it into an inner discharge compartment and a surrounding entry compartment. A body of residual urine 18 extends up to the overflow level at the top of stand pipe 14A and, in conjunction with the overhead plenum region formed by the cap portion 16, the residual body of urine 18 serves to trap sewer gasses from the external drain line in accordance with plumbing codes.

A body of oily liquid sealant 20, lighter than water or urine, floats in the entry compartment on top of the trapped body of urine 18, and serves to trap urine odors from escaping from trap 10A.

In operation of the urinal, urine from above, near the outer edge, separates into droplets that permeate through the layer of sealant 20 and then joins the main body of urine 18. As additional urine enters the body of urine 18, it overflows stand pipe 14A and the overflow portion gravitates down the drain.

Known oil-sealed odor traps are configured as in FIG. 1 with a vertical baffle 16A. From actual experience, traces of sealant can escape during usage. Such depletion occurs as follows. Due to turbulence or emulsification during each usage event, and despite the inherent buoyancy of sealant 20 due to its low density and the non-affinity to water/urine, some droplets of sealant can separate from the main body and get swept downward along with the main flow of urine in the outer chamber. These stray droplets tend to decelerate due their inherent buoyancy and, depending on downward urine flow velocity and travel depth, some of them may come to rest, then reverse and rise against the flow, and return to the main sealant body above. Such droplets thus are recovered. However, any droplets, that are dragged by the urine flow past the bottom of baffle 16A, will then, due to their buoyancy, accelerate upwardly in the inner compartment, defined by drain stand pipe or overflow riser 14A and vertical baffle or portion 16A. Such droplets will then escape through exit opening 14E and down the drain conduit through reduction portion or drain housing 12B.

The present invention, operating on a modified form of the basic principle described above and teaching novel internal structure, can be implemented with the same general cylindrical exterior shape as that of the odor trap shown in FIG. 1, and can be made to fit into a cavity receptacle that is part of a urinal system having an 12A above, leading to tapered upper edges of the outer wall of the main liquid container of odor trap 10A and extending downward around trap 10A to a reduction portion 12B which connects by regular plumbing attachments to the external drain system.

Figure 1A:
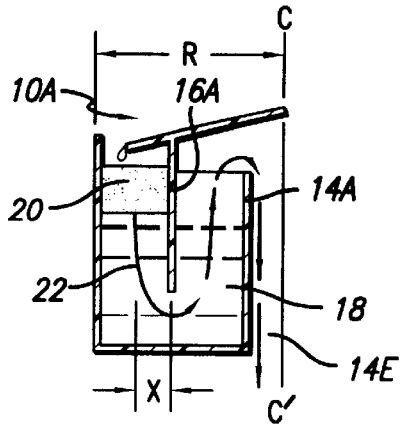
FIG. 1A is functional diagram representing the left hand half of the trap illustrated in FIG. 1.

FIG. 1A is a simplified schematic representation of the left hand half of the symmetrical configuration of FIG. 1 which is coaxial about a central axis C–C', showing again the relation of sealant 20, urine 18 and a sealant flow path 22 in the urine in the entry compartment. It is evident that in this configuration, due to the vertical orientation of baffle 16A, flow path 22 is predominantly vertical, that is, downward in the outer compartment as shown and upward in the inner chamber, with only relatively small horizontal components around the bottom of baffle 16A and around the top of stand tube 14A. Flow path 22, having sealant 20 overhead, is the only portion of the total flow path where sealant recovery can occur; thus a corresponding parameter can be estimated as indicated by dimension x, representing the effective sealant-recovery horizontal flow path length. In a typical odor trap of the category of FIGS. 1 and 1A, with main liquid container 14 having an inside radius R of 5.4 cm, and the baffle 16A having an outside radius of 4 cm, the horizontal recovery dimension x is about 0.8 cm, from which is obtained the unitless ratio x/R=14.8% which characterizes this particular internal structure.

Component x labelled in the figures is an approximate average of the horizontal vector components x of the wastewater flow, extending from the middle of the entry opening (e.g. the point of average entry of the wastewater into the sealant) to a furthest point along the flow path (e.g. around the baffle) in which sealant recovery can occur. Although the invention contemplates a value x based on the approximate average, preferably, generally all of the wastewater will follow a flow math having a component x, e.g., any wastewater not following such a flow path would be insubstantial enough to effect the proper functioning of the invention, such as if extraneous openings were provided to allow a minimal volume flow rate therethrough.

A vertical vector component y of the flow path may be approximately defined as the vertical distance from the top of stand pipe 14A to the bottom of baffle 16A. Accordingly, an alternative feature may be based on a ratio x/y, for use in estimating an effective slope of the flow path, e.g., $x/y<1$ to indicate a predominantly vertical flow path and $x/y>1$ to indicate a predominantly horizontal flow path.

This category of odor trap is vulnerable to total loss of sealant if subjected to water-flushing at high pressure, due to the relatively narrow width of the outer compartment and absence of any sizeable shelter compartment around the entry region to which sealant can be displaced temporarily by the flushing water instead of being forced down the drain.

FIGS. 2–9 are simplified cross-sectional functional diagrams representing various odor trap configurations illustrating principles of the present invention, which is directed to preservation of sealant. For simplicity, as in FIG. 1A, only half of symmetrical cross-sections is shown, along with a central axis. The shapes generally apply to structure that is coaxial about the axis as shown, but the present invention can be practiced by applying such cross-sections to other, non-coaxial and/or non-symmetrical configurations such as rectangular containers or cylindrical containers with non-coaxial internal structure.

Figure 2:
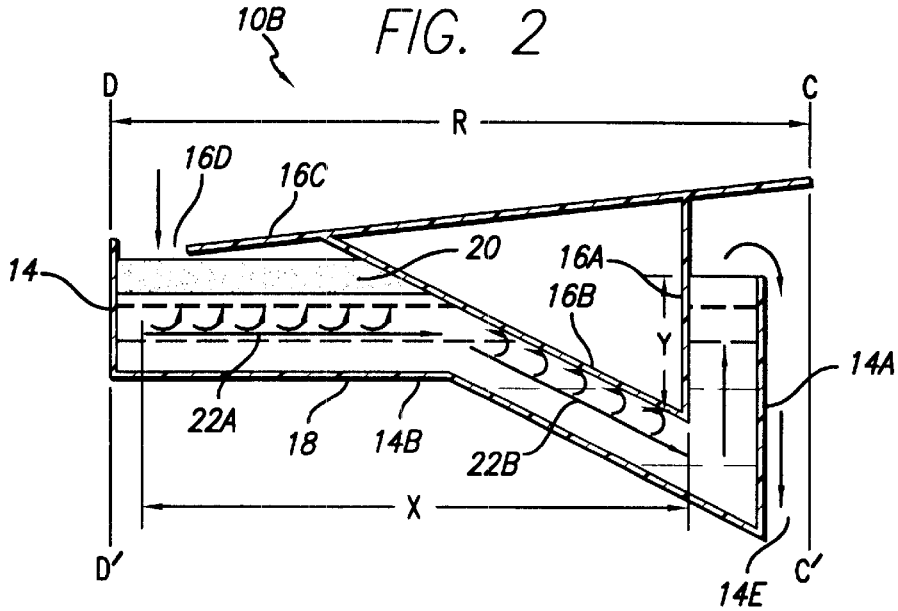
FIGS. 2 and 3 are functional diagram illustrating alternate descriptions of the principles of the present invention utilizing methods for minimizing turbulence in the oil sealant, such as by predominantly horizontal flow and a barrier or shield to direct contact of the waste liquid with the sealant.

FIG. 2 is a conceptual diagram illustrating basic principles of the present invention wherein an odor trap 10B is structured in a novel manner. Rather than configuring the baffle vertical as illustrated in FIGS. 1 and 1A, at least a portion of the baffle is shaped in a non-vertical manner to cause the liquid flow path to be predominantly horizontal, as a major departure from entirely vertical baffles and consequent predominantly vertical liquid flow that has been universal in the known art as described above.

The baffle in FIG. 2 has a vertical portion 16A, facing the vertical wall of drain riser 14A, and an inclined, but substantially horizontal portion 16B sloping up to cover 16C which has an- entry opening 16D at the left. Cover 16C may be defined as an entry region. The contour of bottom portion 14B of main liquid container 14 is shown for simplicity as forming a flow path of substantially constant depth; however in practice, there can be a much greater variation in depth along the flow path.

From an entry opening 16D at the left, the flow is to the right. The liquid flow path has two recovery portions 22A and 22B. In portion 22A, starting at the entry inlet, the flow is horizontal, passing under the main body of sealant 20. Then, in portion 22B, the flow path slopes downward but remains predominantly horizontal as directed by sloping baffle portion 16B. The flow path turns abruptly upward at the plane of vertical baffle portion 16A, to overflow riser 14A and then exits down the drain in the same manner as in FIGS. 1 and 1A.

It is evident that, in both flow path portions 22A and 22B, the flow path is predominantly horizontal, in distinction from the predominantly vertical flow paths in FIGS. 1 and 1A.

In FIG. 2 within the path length x indicated, practically all stray sealant droplets migrating upwardly to the top side of the flow path will be recovered and returned to the main body of sealant 20. In flow path portion 22A, the body of sealant 20 is directly overhead, and along portion 22B the slope of baffle 16B redirects upwardly-migrating stray sealant back to the main body of sealant 20, as indicated by the curved arrows. Since sealant recovery occurs along both of these portions, the recovery dimension x as shown is the sum of the horizontal components of the two portions.

The cross-section of FIG. 2 can be applied to a coaxial cylindrical structure having a central axis about line C–C' and the outer wall of cylindrical container being at D–D', such as wall 14 is shown. Alternatively, the cross-section of FIG. 2 can be applied in reverse manner to provide a coaxial cylindrical odor trap structure of the central-entry type with a central axis at D–D', and outer wall of the cylindrical container at C–C'.

As a further alternative, the cross-section of FIG. 2 can represent that of an enclosure that is other than cylindrical, e.g., rectangular. In addition, the container can alternatively be made with side walls at both D–D' and C–C', such that a non-symmetrical, non-axial, device is formed.

A coaxial structure based directly on FIG. 2 would tend to be shallower and larger in diameter than cartridges shaped as shown in FIG. 1. As a practical limitation, a minimum liquid depth is required in the trap to meet regulations regarding containment of sewer gas pressure in the drain system, e.g., 2 inches in the United States and 50 mm in Europe. Due to existing urinal space limitations, cylindrical traps are typically limited to a maximum diameter of about 150 mm (5.9 inches) and a maximum height of about 90 mm (3.54 inches). To function properly in such a compact size, the conceptual example shown in FIG. 2 is preferably reconfigured in shape with the wasted space between baffle portions 16A, 16B and cover 16C more preferably being utilized.

Figure 3:
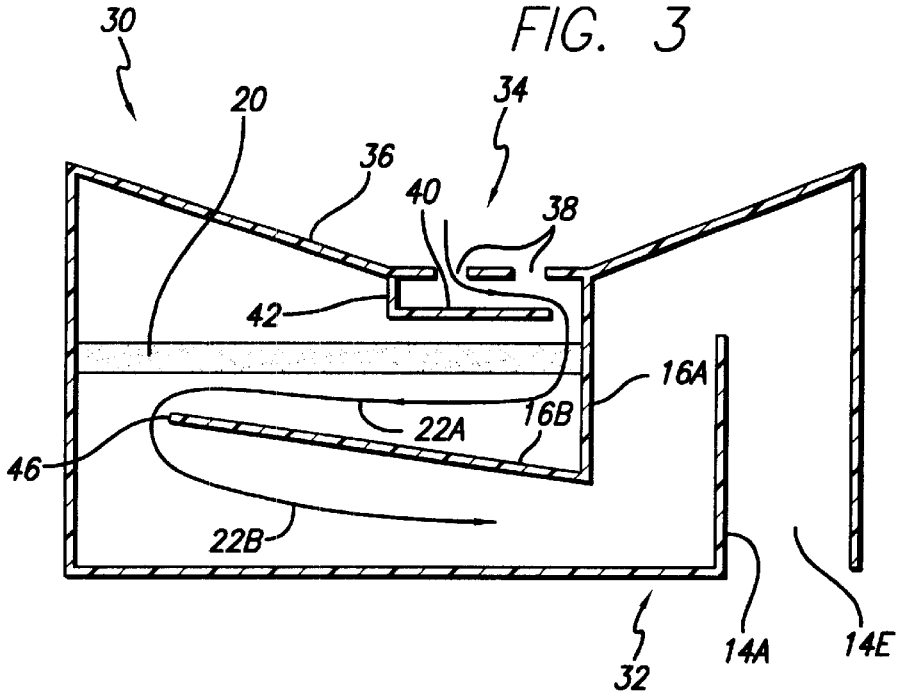

The above stated principles may also be understood with reference to a specific odor trap, such as that depicted in FIG. 3. Here, an odor trap 30, like odor trap 10B of FIG. 2, includes a discharge section 32 which incorporates a similar outlet defined by exit drain stand pipe or overflow riser 14A and vertical baffle or vertical upper portion 16A so that wastewater or urine 18 may be conducted to the external drain system. The wastewater enters odor trap 30 from an entry section or region 34, having an inlet cover 36 having and entry opening defining one or more openings 38 therein to provide a similar function as entry opening 16D. Positioned below openings 38 is a layer of sealant 20 floating upon wastewater 18. The wastewater contacts, flows into and passes through sealant layer 20, and flows atop and beneath portion 16B on its journey into discharge section 32 and out of the odor trap. Such flow of the wastewater ofttimes creates turbulence in the sealant, and results in displacement of the sealant and formation of droplets therefrom, which droplets will migrate beneath portion 16B and pass from the odor trap if not otherwise prevented. The extent of the turbulence and the displacement of sealant layer 20 is directly related to the force of the wastewater contacting the sealant layer, and to the time in which the turbulence can subside.

To mitigate against such force and to provide sufficient time, the extent of the passage of the wastewater atop portion 16B must be controlled. Such control is effected by sufficiently lengthening the passage e.g., by distance x or the like, so that the effect of the wastewater to cause sealant turbulence will be adequately dissipated and so that the sealant likewise will have adequate opportunity to become sufficiently quiescent.

Odor trap 30 also incorporates an additional feature by which turbulence in the oil sealant is minimized. A shield or barrier 40 is positioned between openings 38 and sealant layer 20 to prevent the wastewater from directly striking or otherwise impinging or impacting upon the sealant. Thus, excessive force against and resultant turbulence of the sealant is minimized, if not altogether avoided. Shield 40 is secured to inlet cover 36 by any suitable means, such as by a connector 42. The shield is further oriented with respect to portion 16B so that the shield opens at its terminus 44 towards baffle or baffle portion 16A, and in a direction opposite from terminus 46 of portion 16B. As a result, the distance by which the wastewater passes from openings 38 to terminus 46 of portion 16B is accordingly increased while, at the same time, the wastewater will contact sealant layer 20 with minimum force. The outcome is minimization, if not elimination of sealant droplets passing underneath portion 16B.

The principles and advantages in sealant retention illustrated in FIGS. 2 and 3 can be realized in various odor trap configurations according to the present invention, and constructed and arranged to meet particular practical requirements, such as shown in the following examples.

Figure 4:
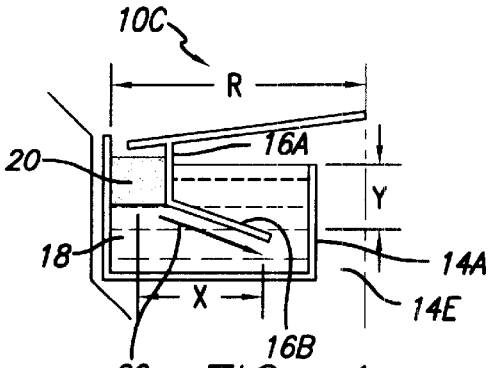
FIGS. 4 and 5 are functional diagrams illustrating two different baffle configurations in edge-entry coaxial trap structures according to the present invention.

FIG. 4 depicts the structure of an edge-entry odor trap 10C having the baffle configured with a vertical upper portion 16A and a sloped portion 16B as shown, providing a flow path 22 corresponding to horizontal recovery dimension x as shown, extending from an averaged entry point to the extremity of sloped baffle portion 16B.

In FIGS. 3 and 4 which depict visible baffle shape variations, the vertical portion 16A can be located anywhere along the sloped portion 16B between the extremes shown in these two figures, while keeping the sloped portion 16B as shown; basic functioning and dimension x would be virtually unaffected.

Figure 5:
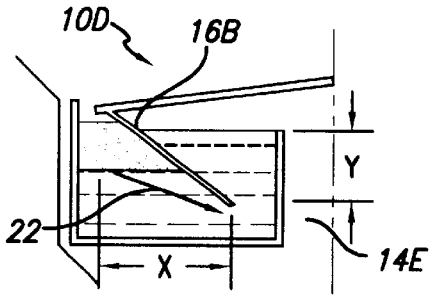

FIG. 5 depicts an odor trap 10D as a variation of FIG. 4 having baffle 16B sloped in its entirety. The flow path 22 and the dimension x are approximately the same as in FIG. 4.

Figure 6:
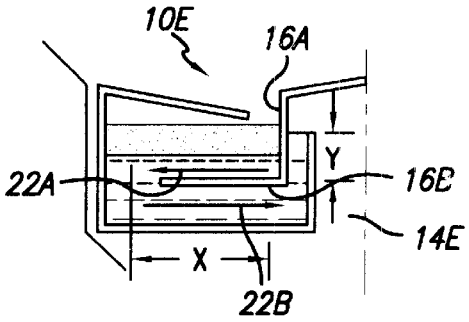
FIGS. 6–9 are functional diagrams illustrating different baffle configurations in center-entry coaxial odor trap structures according to the present invention.

FIG. 6 depicts a center-entry odor trap 10E wherein the baffle is configured with a vertical upper portion 16A and a horizontal lower portion 16B flanged outwardly as shown. This creates a folded liquid path having, upper portion 22A above and lower portion 22B as shown. Only the upper portion 22A will be effective in returning stray sealant because baffle 16A is not sloped.

Thus, stray sealant in the portion 22B will tend to get swept along to the right and escape to the drain along with the effluent. Horizontal recovery dimension x will be as indicated, derived from upper flow path portion 22A.

Figure 7:
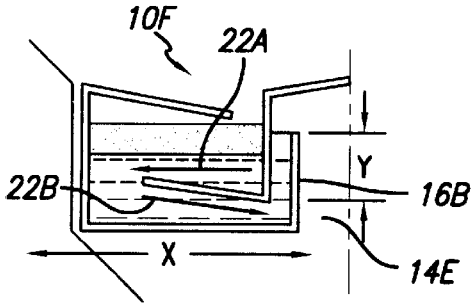

FIG. 7 depicts an odor trap 10F as a variation of FIG. 6 wherein lower baffle portion 16B is sloped as shown so as to recapture stray sealant from lower horizontal flow path 22B, thus adding to upper path 22A to yield the indicated much greater horizontal recovery dimension x.

Figure 8:
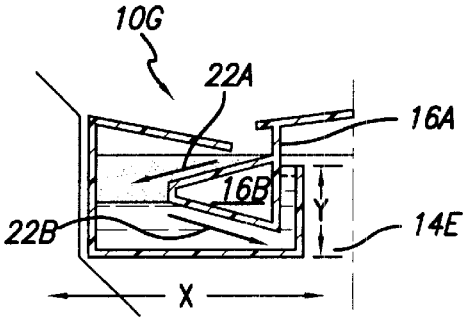

FIG. 8 depicts an odor trap 10G as a variation of FIG. 7 wherein the sloped flange portion 16B is made to have an oppositely-slope upper surface which serves to prevent accumulation of debris on the flange's upper surface which could otherwise occur in this region in the structure of FIG. 7. Dimension x is virtually the same as in FIG. 7.

Figure 9:
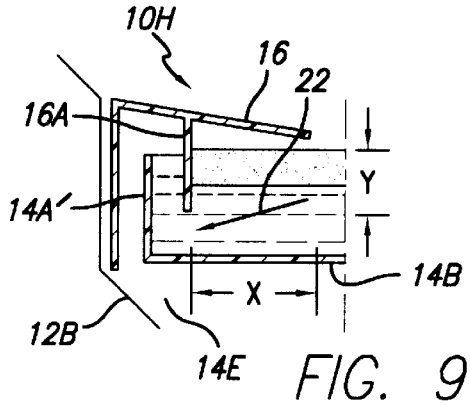

FIG. 9 depicts an odor trap 10H as a reversed version of the foregoing center entry coaxial configurations which achieves a form of predominantly horizontal flow path with a simple vertical baffle 16A surrounded by a drain stand wall 14A' which sets the overflow level. Wall 14A', surrounded by an outer wall extending down from the circumference of cover 16C, is attached to the circumference of floor 14B so as to form a simple cylindrical main container pan 14 which can be supported by surrounding cover 16C or drain housing 12B by radial vanes (not shown). The center entry causes the liquid to spread out radially in a sloped but substantially horizontal flow path 22 leading to the bottom edge of baffle 16A as shown, corresponding to recovery dimension x as indicated.

In FIGS. 6–9, a triangular-shaped empty region can be seen in cross-section above the sealant, as formed by the slope of the cover. This triangular region serves an important function as a sealant shelter region into which the sealant tends to be displaced in the event of high-pressure water flushing, instead of being forced down the drain ahead of the flushing water, as could occur with trap structure of known art, such as in FIGS. 1 and 1A, having the conventional vertical baffle 16A and the conventional predominantly vertical flow paths.

Figure 10:
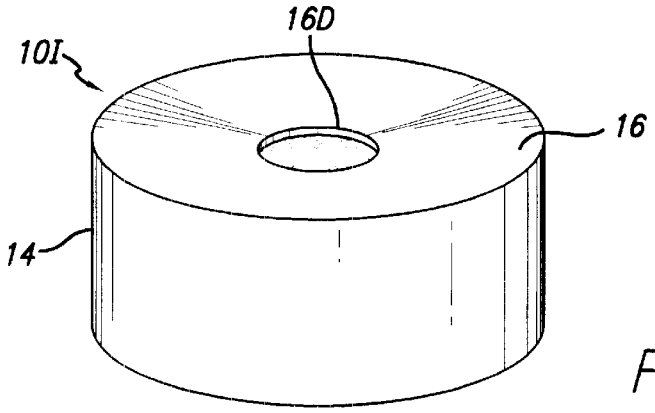
FIG. 10 is a three-dimensional view of a center-entry cylindrical odor trap cartridge.

FIG. 10 is a three-dimensional view of a cylindrical odor trap cartridge 10I with center entry 16D in accordance with a preferred embodiment of the present invention. The upper surface slopes downward in a shallow inverted cone toward the center where entry opening 16D is fitted with a filter screen or a fine perforation pattern formed in the cover material.

The enclosure can be, for example, dimensioned about 4½ inches (11.4 cm) in diameter and 2¾ inches (7.0 cm) in height. As noted, due to existing industry limitations, the size of the trap is to be limited. For example, the diameter of the trap is preferably between about 2 to 2½ inches. It is preferably molded from polyethylene, or from another suitable plastic material such as polypropylene, ABS or polystyrene, to provide a smooth stain-resistant surface. The material can also include a fiberglass reinforced polyester. Other suitable materials can also be utilized. Typically, main container 14 and cap/partition part 16 are molded as separate parts and then bonded together to form an integral enclosure, since access to the interior is not normally required. The entry configuration of trap 10I makes it feasible to seal entry opening 16D (with the bottom exit opening, not visible in FIG. 10, sealed in a similar or other manner) for shipment as a cartridge already charged with sealant, ready for deployment. For example, to seal opening 16D, a sticker can be attached thereto, and can further include labelling, etc., such as installation instructions and product labelling.

Figure 11:
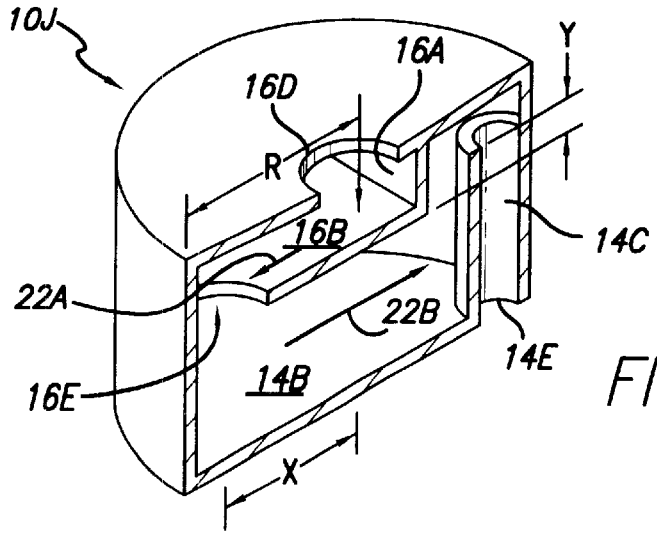
FIG. 11 is a three-dimensional cutaway view of an embodiment of a horizontal-flow odor trap cartridge of the present invention having a cylindrical container and a non-coaxial internal configuration with vertical and horizontal baffle portions and an offset tubular drain stand.

FIG. 11 is a three-dimensional cutaway view of a center-entry cylindrical odor trap 10J having a non-coaxial interior configuration, shown without liquid for clarity. The baffle has two flat portions. Vertical portion 16A extends downward from the upper surface offset to the right of entry opening 16D. At the bottom of vertical baffle portion 16A, a horizontal portion 16B extends fully to the left hand wall of odor trap 10J. A round opening 16E, about the same size as opening 16D, is configured in a horizontal baffle portion 16B at the edge furthest from vertical baffle portion 16A. Opening 16E leads into a lower compartment which is configured with a flat floor 14B of which a portion is extended upwardly at the right hand side to form tubular drain stand 14C whose top edge defines the overflow level of the container as in the figures described above. Liquid flow paths 22A and 22B are shown and corresponding recovery path dimension x is indicated as derived from path 22A.

Figure 12:
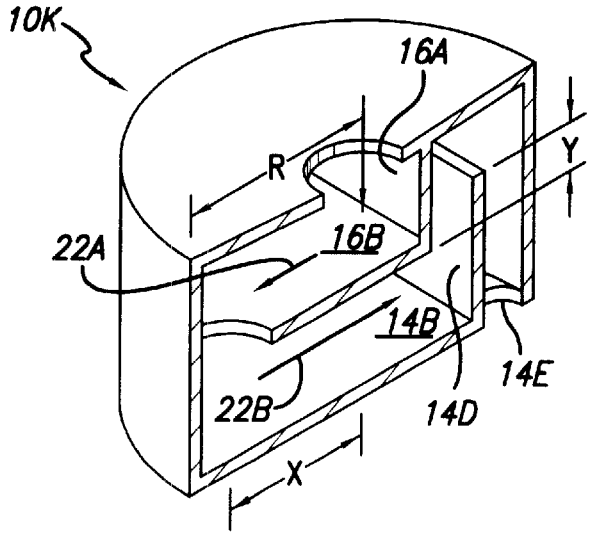
FIG. 12 shows an alternative illustrative embodiment derived from FIG. 11 with a flat-partitioned drain stand.

FIG. 12 depicts an odor trap 10K which is a variation having a baffle configured as in FIG. 11 but wherein drain riser 14D is here configured as a flat vertical riser wall 14D attached integrally to floor 14B and to the interior wall of main enclosure 14 of odor trap 10L, preferably molded together in one piece.

Figure 13:
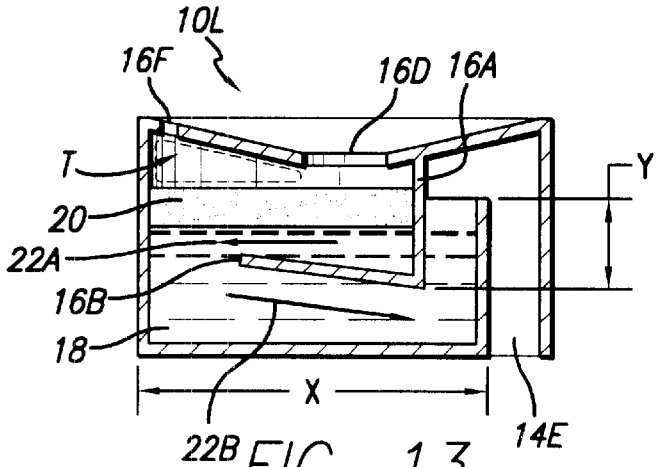
FIG. 13 shows a cross-sectional view of a preferred embodiment of the present invention, similar to FIGS. 11 or 12, but having the lower baffle portion sloped for additional recovery of stray sealant.
Figure 16:
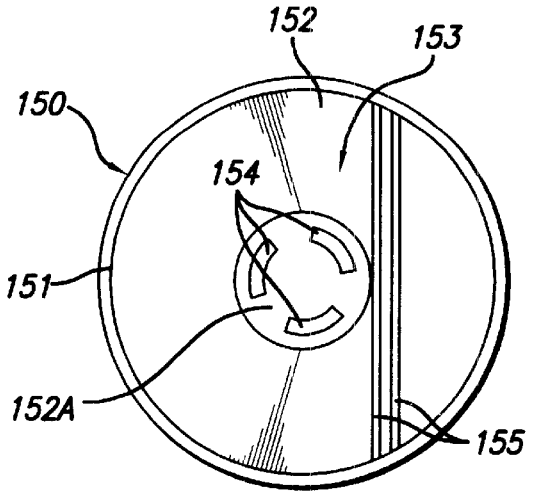
FIGS. 16–19 show one preferred construction of the preferred embodiment of FIG. 14.
Figure 17:
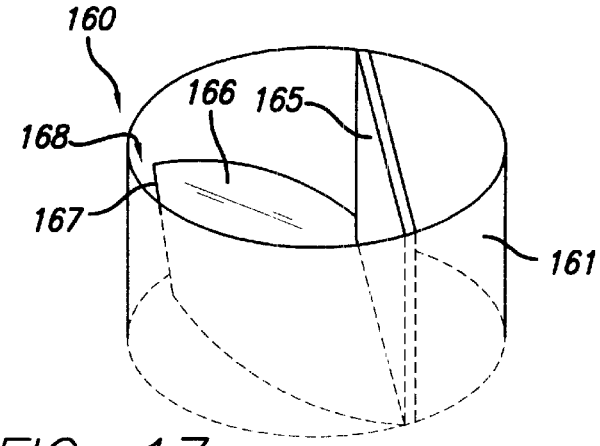

FIG. 13 is a central cross-section depicting an odor trap that represents an important variation applicable to both FIG. 11 and FIG. 12. Horizontal baffle portion 16B is sloped in a manner to recover stray sealant and return it to the main body of sealant 10. The resultant horizontal recovery dimension x is much longer than in FIGS. 11 and 12 due to the additional recovery provided by sloped baffle portion 16B.

It is seen that the cross-sections of FIGS. 11 and 12 generally resemble that of FIG. 6, and the cross-section of FIG. 13 generally resembles that of FIG. 7. However, preferred constructions according to FIGS. 6 and 7 as shown imply fully coaxial internal and external configuration centered on axis C–C' whereas the internal structure in FIGS. 11–13 is clearly non-coaxial with the outlet offset rather than centered and the baffles flat rather than cylindrical.

The relative sealant recovery effectiveness of the above configurations as approximated by the recovery-effective length of the horizontal flow paths x relative to container radius R can be compared in the following estimated table. The following Table I lists examples of estimated values which can be achieved for x/R in the illustrated embodiments, the illustrated embodiments not being limited thereto:

TABLE 1

| FIG. | x/R | FIG. | x/R |
|---|---|---|---|
| 1, 1A | 15% | 8 | 56% |
| 2 | 76% | 10 | 71% |
| 3, 4, 5 | 50% | 12 | 165% |
| 6, 7 | 105% | | |

Alternatively, the relative sealant recovery effectiveness of the above configurations, as a few examples, can be expressed as a function of the flow path slope x/y. The following Table 2 lists estimated examples of values which can be achieved for x/y in the illustrated embodiments, the illustrated embodiments not being limited thereto.

TABLE 2

| FIG. | x/y | FIG. | x/y |
|---|---|---|---|
| 1, 1A | 0.12 | 7 | 8.60 |
| 2 | 4.64 | 8 | 3.67 |
| 3, 4 | 3.50 | 10, 11 | 3.08 |
| 5 | 5.50 | 12 | 5.82 |
| 6 | 5.75 | | |

According to the preferred embodiments of the present invention, the inlet and outlet locations and the baffle configuration, etc., result in a predominantly horizontal flow. For example, in some preferred embodiments, the present invention yields preferred values of x/R>30%, as distinguished, for example, from predominantly vertical flow of known art in the above table. As seen in Table 1, the present invention can even yield values greater than 50%, allowing for a wide margin above the 15% estimated for the noted prior art. As another example, the present invention can yield preferred values of x/y of greater than 1.0, while the above-noted estimate of the noted prior art achieves a value substantially less than 1.0. Although clearly less preferred, it is contemplated that values less than the preferred examples of x/R and/or x/y can, in some cases, be used according to principles of the invention.

It is recognized that a one-dimensional parameter, such as x/R, is merely a first approximation of effectiveness; a more refined two-dimensional parameter would take into account the effective horizontal recovery area located above the flow path. An even more refined three-dimensional parameter would take into account fluid viscosities, width, depth and length and resulting flow velocities at various incremental points in the flow paths.

The relative effectiveness indicated by the above tables apply to normal operation and does not necessarily include the additional improvement provided by the present invention in protection against catastrophic loss of sealant under the condition of high pressure water flushing as described above. In this regard, according to another aspect of the invention, a shelter region is provided for the sealant, and can be provided in any of the embodiments of the invention. The configurations of the embodiments of, for example, FIGS. 11–13, include entry compartments with shelter regions (e.g., as identified by indicium T shown in FIG. 13) wherein high-pressure flushing water tends to take a direct path from entry opening 16D to baffle opening 16E while parting much of the sealant and temporarily pushing it into the shelter regions at both sides. In addition to their other functions, the angled top wall and the wide entry compartment help provide such shelter regions. The shelter region is preferably formed by an airspace T above the normal sealant level, such as shown in FIG. 13. In order to allow the sealant to quickly enter the shelter region, the device can include one or more air vents to allow air within the shelter region to vent outside thereof. For example, the embodiment shown in FIG. 13 includes at least one air vent 16F at an upper end of the trap. Air vent 16F is sized to allow air to pass therethrough while substantially preventing fluid flow therethrough, and preferably has a diameter of about 1–2 mm. As shown, the air vent is preferably in the top wall of the device. In this manner, in the event that any sealant is forced through the air vent, the sealant can be redirected along the upper surface and into upper opening 16D so as to return to the body of sealant.

FIG. 14 shows another preferred embodiment of the invention. The device shown in FIG. 14 employs a number of features which are similar to certain features shown in FIGS. 11–13. FIG. 14 is a three-dimensional cutaway view of an odor trap 10M having a non-coaxial interior configuration. The baffle has a generally vertical portion 16A extending downward from the upper surface, offset to the right of entry opening 16D, and a horizontal portion 16B extending fully to the left hand wall of odor trap 10M at the bottom of vertical baffle portion 16A. The horizontal baffle extends only partially across the trap so as to leave an opening 16E at the edge furthest from vertical baffle portion 16A. Opening 16E leads into a lower compartment which is configured with a floor 14B. A tubular drain stand 14C is provided which extends upward at the right hand side of floor 14B. The top edge of drain stand 14C defines the overflow level of the container. Liquid flow oaths 22A and 22B provide a corresponding recovery path dimension x similar to that shown in FIG. 13, e.g., the sum (x1+x2) from the paths 22A and 22B, respectively. As shown in FIG. 14, a body of wastewater 18 has sealant layer 20 buoyantly floating thereon. Wastewater 18 follows the flow path (a) 22I into the entry opening 16D, (b) 22A above the baffle, (c) 22B below baffle 16B, (d) 22C up and over the top edge of drainstand 14C, and (e) 22D down drainstand 14C.

Figure 19:
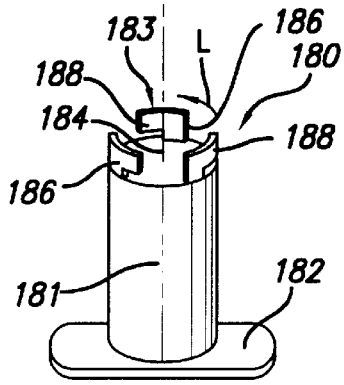
Figure 18:
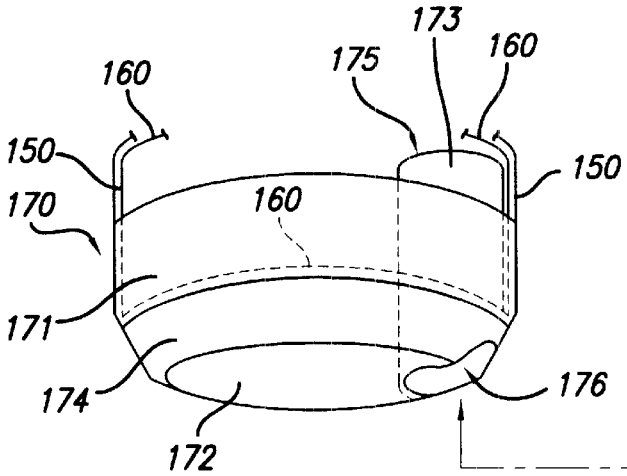

FIGS. 16–19 show a preferred construction of the embodiment shown in FIG. 14. This preferred construction includes a top member 150 (FIG. 16), a middle member 160 (FIG. 17), a bottom member 170 (FIG. 18), and a plug member 180 (FIG. 19). Top member 150 includes a generally cylindrical perimeter wall 151, a downwardly inclined top wall 152 having a center area 152A, and an entry opening 153 at the center area of the top wall. Top wall 152 is inclined in a manner like that in FIG. 14. As shown, the entry opening preferably includes three holes 154 in center area 152A of the top wall. In addition to their function as described below, holes 154 also serve as the openings for passage of urine or other wastewater into the odor trap. The top wall also preferably includes two sealing ridges 155 for receiving and sealing baffle 165, as discussed below.

Middle member 160 includes a perimeter wall 161 and a baffle having a generally vertical portion 165 and an upwardly inclined portion 166. Portion 166 has a generally straight upper edge 167 providing a fluid passage 168 around the baffle.

Bottom member 170 includes a perimeter wall 171, a bottom wall 172, and a upwardly extending drain stand 173. The drain stand preferably is a cylindrical tube extending above wall 171 with an upper opening 175 and a lower opening 176. The lower edge of the bottom member can, for example, as shown include a tapered wall 174.

The device is assembled with the middle member fitted such that perimeter wall 161 snugly fits within perimeter wall 151 and baffle portion 165 snugly fits between ridges 155. Wall 151 only extends down over part of the height of wall 161. Lower member 170 fits with drain stand 173 within the area to the right of baffle portion 165 and the lower portion of cylindrical wall 161 snugly fitted within cylindrical wall 171. As a result, a sealed container can be constructed having separately isolated entry and discharge compartments.

Figure 20:
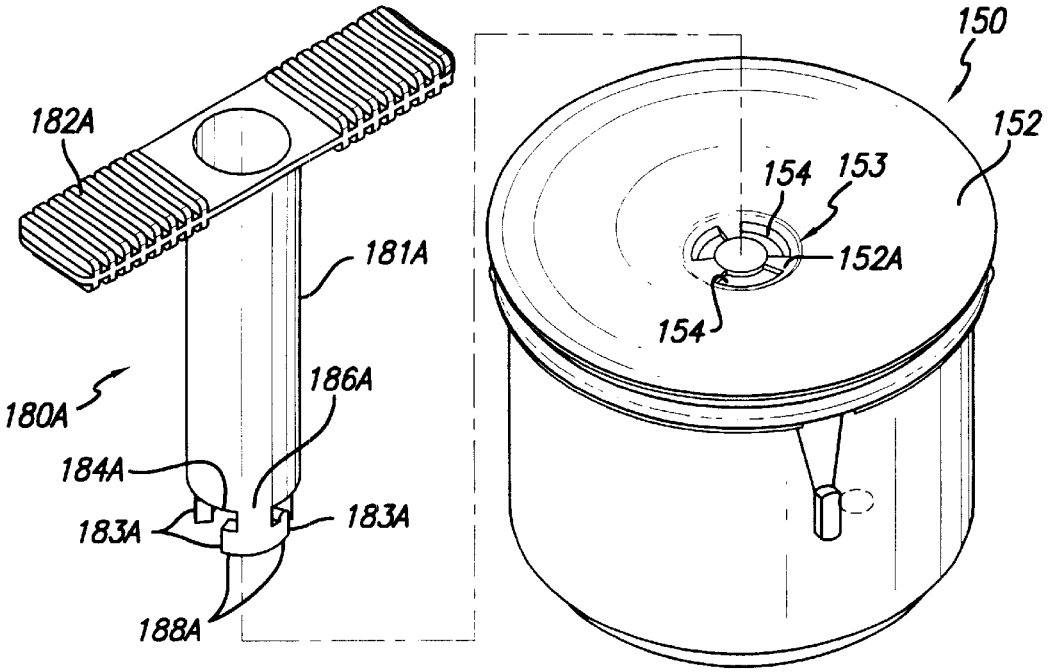
FIG. 20 depicts an alternate construction of the plug-handle member illustrated in FIG. 19.

FIGS. 19 and 20 show plug-handle members 180 and 180A which can be included in this latter embodiment. Each plug-handle member 180 (180A) preferably includes a tubular member 181 (181A), handle projections 182 (182A) and hook-shaped projections, such as L-shaped and T-shaped projections 183 and 183A, at upper wall 184 (184A). Each projection 183 and 183A includes a vertical portion 186

(186A) and one horizontal portion 188 for projection 183 and two horizontal portions 188A for projection 183A. The plug is preferably shaped and sized so as to snugly fit within drain stand 173. With this construction, the odor trap can be transported with a body of sealant within the assembled structure, if plug 180 (180A) is inserted in opening 176 and a seal (such as an adhesive backed label) is placed over opening 153. As shown, the L-shaped and T-shaped projections are sized and shaped to fit within holes 154 so that the assembled device can be carried by simply inserting the projections into the holes 154 and by rotating plug 180 (180A) in the direction L of respective FIG. 19 and similarly in FIG. 20, so that the L-shaped and T-shaped projections engage under top wall 152. Thus, member 180 (180A) provides a tool that can be used to seal a new, unused unit and to remove a dirty, wastewater filled, unit. Although the plug and handle functions are preferably combined into single tool 180 (180A), it is contemplated that separate devices embodying these features can be included and/or either the plug or handle can be eliminated depending on the desired handling.

Sealant 20 is preferably a biodegradable oily liquid. A preferred composition of liquid 20 comprises an aliphatic alcohol containing 9–11 carbons in the chemical chain, wherein the specific gravity is 0.84 at 68° Fahrenheit. Since the operation of the urinal is based on the differential between the specific gravity of the oily liquid and that of urine, typically near 1.0, the specific gravity of the oily liquid should be made as low as possible, preferably not exceeding 0.9 and, preferably, well under 0.9. Sealant 20 preferably is chosen to have a very low affinity to water so that the sealant and the urine strongly repel each other physically and so that there is no chemical or other interaction apart from a purely physical separation which allows urine/water from above to divide finely and permeate downwardly through the sealant layer. Sealant 20 is preferably colored, e.g., blue, for maintenance and identification purposes.

FIG. 15 shows one example of type of urinal into which the various odor traps, shown generally as 10, can be located. The illustrated urinal, designated by indicium 140,is a wall mounted unit attached above a floor surface (not shown). The urinal shown is for illustrative purposes only; a trap of the present invention can be used in any type of urinal. More notably, the utility of the invention, while directed in some aspects to waterless urinals as illustrated above, is not restricted thereto. The present odor trap is applicable to other drained surfaces and the like. For example, since the preferred sealant utilized is considerably more stable than water with regard to evaporation, the present invention has widespread utility as floor drains, solving, for example, problems of sewer gas release from conventional S-type floor drains resulting from, for example, total seal failure due to evaporation of the residual water and lack of replenishment thereof, particularly in hot, dry climates.

Although the invention has been described with respect to particular embodiments thereof, it should be realized that various changes and modifications may be made therein without departing from the spirit and scope of the invention.

What is claimed is:

1. In an odor trap apparatus for conveyance of wastewater to an external drain, comprising (a) a container having an opening entry for receiving the wastewater therein, (b) a baffle in said container dividing said container into an entry compartment into which the wastewater is received through said opening entry and a discharge compartment communicating with and defining therewith a liquid flow path passing along at least one surface of said baffle, (c) an outlet communicating said discharge compartment with the external drain, and (d) a quantity of low-density liquid in said entry compartment forming a sealant layer above the wastewater in said entry compartment, the improvement in which:

said baffle extends a generally extending horizontal distance, measured from said opening entry to an end of said baffle, around which the wastewater passes; and the distance is sufficiently large as to at least minimize turbulence in said sealant layer adjacent said baffle end.

2. The improvement according to claim 1 further including a shield positioned between said entry opening and said baffle for preventing direct impact of the wastewater upon said sealant layer.

3. The improvement according to claim 2 in which said shield terminates in an end which extends in a direction opposite from said baffle end for lengthening the horizontal distance in the flow path.

4. The improvement according to claim 3 further including an inlet cover incorporating said opening entry, and in which said shield includes a barrier portion positioned generally under said entry opening and a connector connecting said barrier portion to said inlet cover.

5. The improvement according to claim 4 further including a shelter region formed between said baffle and said inlet cover adjacent said baffle end, and at least one air vent in said inlet cover for allowing air within said shelter region to vent outside thereof and thereby for lessening the effects of any high pressure of the wastewater from deleteriously affecting said sealant layer.

6. The improvement according to claim 1 further including an inlet cover incorporating said opening entry and a shelter region formed between said baffle and said inlet cover adjacent said baffle end, and at least one air vent in said inlet cover for allowing air within said shelter region to vent outside thereof and thereby for lessening the effects of any high pressure of the wastewater from deleteriously affecting said sealant layer.

7. The improvement according to claim 1 in which:

said discharge compartment includes a drain having an edge defining an overflow level of said container;

said opening entry includes at least one top opening through which substantially all of the wastewater enters into said container; and the horizontal distance is measured by a length (x), which is measured from each said at least one top opening to said baffle end and which is larger than a vertical distance (y) measured from said overflow level to the bottom of said baffle.

8. The improvement according to claim 1 in which:

said discharge compartment includes a drain having an edge defining an overflow level of said container;

said opening entry includes at least one top opening through which substantially all of the wastewater enters into said container; and the horizontal distance is measured by a length (x), which is measured from each said at least one top opening to an end of said baffle around which the wastewater passes, and which is greater than 30% of a dimension (R), at a height at the bottom of said baffle, from a center of said container to a side thereof.

9. In an odor trap apparatus for conveyance of wastewater to an external drain, comprising (a) a container having an opening entry for receiving the wastewater therein, (b) a baffle in said container dividing said container into an entry compartment into which the wastewater is received through said opening entry and a discharge compartment communicating with and defining therewith a liquid flow path passing above and beneath said baffle, (c) an outlet communicating said discharge compartment with the external drain, and (d) a quantity of low-density liquid in said entry compartment forming a sealant layer above the wastewater in said entry compartment, the improvement in which:

said baffle extends a generally extending horizontal distance, measured from said opening entry to an end of said baffle, around which the wastewater passes; and the distance is sufficiently large as to permit the wastewater to pass substantially fully through the sealant neighboring said baffle end.

10. In an odor trap apparatus for conveyance of wastewater to an external drain, comprising (a) a container having an opening entry for receiving the wastewater therein, (b) a baffle in said container dividing said container into an entry compartment into which the wastewater is received through said opening entry and a discharge compartment communicating with and defining therewith a liquid flow path passing above and beneath said baffle, (c) an outlet communicating said discharge compartment with the external drain, and (d) a quantity of low-density liquid in. said entry compartment forming a sealant layer above t he wastewater in said entry compartment, the improvement in which:

said baffle extends a generally extending horizontal distance, measured from said opening entry to an end of said baffle, around which the wastewater passes;

the distance is sufficiently large as to at least minimize turbulence in said sealant layer adjacent said baffle end; and a shield positioned between said entry opening and said baffle for preventing impact of the wastewater upon said sealant layer.

11. The improvement according to claim 10 in which said shield terminates in an end which extends in a direction opposite from said baffle end for lengthening the horizontal distance in the flow path.

12. The improvement according to claim 11 further including an inlet cover incorporating said opening entry, and in which said shield includes a barrier portion positioned generally under said entry opening and a connector connecting said barrier portion to said inlet cover.

13. The improvement according to claim 12 further including a shelter region formed between said baffle and said inlet cover adjacent said baffle end, and at least one air vent in said inlet cover for allowing air within said shelter region to vent outside thereof and thereby for lessening the effects of any high pressure of the wastewater from deleteriously affecting said sealant layer.

14. In an odor trap apparatus for conveyance of wastewater to an external drain, comprising (a) a container having an opening entry for receiving the wastewater therein, (b) a baffle in said container dividing said container into an entry compartment into which the wastewater is received through said opening entry and a discharge compartment communicating with and defining therewith a liquid flow path passing above and beneath said baffle, (c) an outlet communicating said discharge compartment with the external drain, and (d) a quantity of low-density liquid in said entry compartment forming a sealant layer above the wastewater in said entry compartment, the improvement in which:

said baffle extends a generally extending horizontal distance, measured from said opening entry to an end of said baffle, around which the wastewater passes;

the distance is sufficiently large as to at least minimize turbulence in said sealant layer adjacent said baffle end, and an inlet cover incorporating said opening entry and a shelter region formed between said baffle and said inlet cover adjacent said baffle end, and at least one air vent in said inlet cover for allowing air within said shelter region to vent outside thereof and thereby for lessening the effects of any high pressure of the wastewater from deleteriously affecting said sealant layer.

15. An odor trap apparatus for conveyance of wastewater, including:

(a) a main liquid container having at least one top opening through which substantially all of the wastewater enters into said container;

(b) a baffle in said container dividing said container into
(i) an entry compartment receiving the wastewater through said at least one top opening, and
(ii) a discharge compartment receiving the wastewater from said entry compartment along a liquid flow path beneath said baffle, and having a passage point around which the wastewater passes traveling from the entry compartment to the discharge compartment;

(c) a drain in said discharge compartment having an edge defining an overflow level and an outlet communicating with an external drain;

(d) a quantity of liquid sealant having a density lower than that of the wastewater contained in said entry compartment and being adapted to form a sealant layer floating on the body of the wastewater when said container has a body of the wastewater filled to the overflow level, wherein, prior to reaching said passage point, any of said liquid sealant that is drawn beneath the sealant layer by the force of the wastewater can rise back to said sealant layer, and that after passing said passage point, liquid sealant cannot rise back to said sealant layer; and (e) a linear distance (x) which is measured from said at least one top opening and extends along the length of said baffle along which the wastewater flows to said passage point, and which is larger than a vertical distance (y) measured from said overflow level to the passage point.

16. In an odor trap apparatus for conveyance of wastewater to an external drain, comprising (a) a container having an opening entry for receiving the wastewater therein, (b) a baffle in the container dividing the container into an entry compartment into which the wastewater is received through the opening entry and a discharge compartment communicating with and defining therewith a wastewater fluid flow path in the compartments which passes above and beneath the baffle and about an end thereof, (c) an outlet communicating the discharge compartment with the external drain, and (d) a quantity of low-density liquid in the entry compartment forming a sealant layer above the wastewater in the entry compartment, a method for conserving the quantity of the liquid, comprising the steps of:

disposing a portion of the baffle under the sealant layer, for a distance between the opening entry to the baffle end which is sufficient to permit the wastewater to pass through the sealant layer and at least to minimize turbulence in the sealant layer from the wastewater neighboring the baffle end.

17. In an odor trap apparatus for conveyance of wastewater from an entry to an external drain along a flow path that passes through a quantity of liquid odor sealant floating on the wastewater, a method for conserving the quantity of the liquid, comprising the steps of:

disposing a baffle under the sealant for lengthening the flow path above and beneath the baffle and about an end thereof; and extending the baffle, for a distance between the entry to the baffle end, sufficient to minimize turbulence in the sealant from the wastewater neighboring the baffle end.

18. In and odor trap apparatus for conveyance of wastewater from an entry to an external drain along a flow path that passes through a quantity of liquid odor sealant floating on the wastewater, a method for conserving the quantity of the liquid, comprising the steps of:

disposing a baffle under the sealant for lengthening the flow path above and beneath the baffle and about an end thereof; and extending the baffle, for a distance between the entry to the baffle end, sufficient to permit the wastewater to pass substantially fully through the sealant neighboring the baffle end.

19. A method according to claim 17 further comprising the step of shielding the sealant from direct impact by the wastewater.

20. A method according to claim 19 in which said shielding step comprises the step of positioning a shield between the entry and the wastewater.

21. A method according to claim 20 further comprising the step of terminating the shield at an end which extends in a direction opposite from the baffle end for lengthening the distance between the entry to the baffle end.

22. A method according to claim 21 further comprising the steps of providing:

a sheltering region between the baffle and an inlet cover incorporating the entry; and at least one air vent in the cover for allowing air within the shelter region to vent outside thereof and thereby for lessening the effects of any high pressure of the wastewater from deleteriously affecting the sealant.

23. A method according to claim 17 further comprising the steps of providing:

a sheltering region between the baffle and an inlet cover incorporating the entry; and at least one air vent in the cover for allowing air within the shelter region to vent outside thereof and thereby for lessening the effects of any high pressure of the wastewater from deleteriously affecting the sealant.

24. In an odor trap apparatus for conveyance of wastewater from an entry to an external drain along a flow path that passes through a quantity of liquid odor sealant floating on the wastewater, a method for conserving the quantity of the liquid, comprising the steps of:

disposing a baffle under the sealant for lengthening the flow path above and beneath the baffle and about an end thereof;

extending the baffle, for a distance between the entry to the baffle end, sufficient to minimize turbulence in the sealant from the wastewater neighboring the baffle end; and extending the baffle, for a distance between the entry to the baffle end, sufficient to permit the wastewater to pass substantially fully through the sealant neighboring the baffle end.

25. In an odor trap apparatus for conveyance of wastewater from an entry to an external drain along a flow path that passes through a quantity of liquid odor sealant floating on the wastewater, a method for conserving the quantity of the liquid, comprising the steps of:

disposing a baffle under the sealant for lengthening the flow path above and beneath the baffle and about an end thereof;

extending the baffle, for a distance between the entry to the baffle end, sufficient to minimize turbulence in the sealant from the wastewater neighboring the baffle end;

a sheltering region between the baffle and an inlet cover incorporating the entry; and at least one air vent in the cover for allowing air within the shelter region to vent outside thereof and thereby for lessening the effects of any high pressure of the wastewater from deleteriously affecting the sealant.

26. An odor trap, for placement in and removal from drain connected apparatus, including waterless urinals and anti-evaporation floor drains, and for conducting wastewater to an external drain, comprising:

a container having a top cover provided with an opening entry portion therein for receipt of the wastewater and for conducting the wastewater through a flow path which includes a quantity of low-density liquid adapted to form a sealant layer, and to the external drain;

said opening entry including a plurality of openings through which the wastewater passes into said container; and a tool having hook-shaped projections therein for engagement with said openings for enabling insertion and removal of said container into and from the apparatus.

27. An odor trap according to claim 26 in which said hook-shaped projections are provided with at least one hook for engagement with the underside of said cover adjacent said openings.

28. An odor trap according to claim 26 in which each of said hook- shaped projections comprises at least one vertical portion and at least one horizontal portion.

29. In an odor trap, which is adapted for placement in and removal from drain connected apparatus, including waterless urinals and anti- evaporation floor drains, and for conducting wastewater to an external drain, and which includes (a) a container having a top cover provided with an opening entry portion therein for receipt of the wastewater and for conducting the wastewater through a flow path which includes a quantity of low-density liquid adapted to form a sealant layer, and to the external drain, and (b) the opening entry including a plurality of openings through which the wastewater passes into the container, a method for inserting and removing the container into and from the apparatus comprising the steps of:

utilizing a tool having hook-shaped projections therein; and engaging the projections into the openings.

30. A method according to claim 29 in which said engaging step includes the step of providing the hook-shaped projections with at least one hook, and engaging the hooks of the projections with the underside of the cover adjacent the openings.

* * * * *